US009352886B2

(12) United States Patent
Baillies

(10) Patent No.: US 9,352,886 B2
(45) Date of Patent: May 31, 2016

(54) TRAPPED ELEMENT SECURITY CONTAINER

(71) Applicant: Jeffrey S. Baillies, Oregon, WI (US)

(72) Inventor: Jeffrey S. Baillies, Oregon, WI (US)

(73) Assignee: Placon Corporation, Madison, WI (US)

( * ) Notice: Subject to any disclaimer, the term of this patent is extended or adjusted under 35 U.S.C. 154(b) by 260 days.

(21) Appl. No.: 14/086,329

(22) Filed: Nov. 21, 2013

(65) Prior Publication Data

US 2015/0136777 A1 May 21, 2015

(51) Int. Cl.

| | |
|---|---|
| ***B65D 17/32*** | (2006.01) |
| ***B65D 43/02*** | (2006.01) |
| ***B65D 25/20*** | (2006.01) |
| ***B65D 43/16*** | (2006.01) |
| ***B65D 25/22*** | (2006.01) |
| *B65D 25/04* | (2006.01) |

(52) U.S. Cl.

CPC ..... *B65D 43/0235* (2013.01); *B65D 25/205* (2013.01); *B65D 25/22* (2013.01); *B65D 43/162* (2013.01)

(58) Field of Classification Search

CPC ..... B65D 43/0235; B65D 25/205; B65D 43/162; B65D 25/22

USPC ..... 220/270, 4.21, 4.24, 528, 522, 4.23

See application file for complete search history.

(56) References Cited

U.S. PATENT DOCUMENTS

| | | | | |
|---|---|---|---|---|
| 3,901,000 | A * | 8/1975 | Peters | B65B 11/50 426/389 |
| 5,209,354 | A | 5/1993 | Thornhill et al. | |
| 6,047,819 | A | 4/2000 | Borst et al. | |
| 6,131,760 | A * | 10/2000 | Huang | B65D 25/04 220/326 |
| 7,246,556 | B1 * | 7/2007 | Stoneberg | B41K 1/54 101/333 |
| 7,255,230 | B1 | 8/2007 | Appelbaum | |
| 7,819,279 | B2 * | 10/2010 | Galland | B65D 75/32 206/1.5 |
| 8,056,750 | B2 * | 11/2011 | Vovan | B65D 43/021 220/266 |
| 8,083,089 | B2 * | 12/2011 | Vovan | B65D 43/162 220/270 |
| 8,105,638 | B2 * | 1/2012 | Harlfinger | B65D 43/0206 220/4.21 |
| 8,109,388 | B2 | 2/2012 | Rosendall et al. | |
| 8,251,249 | B1 * | 8/2012 | Vovan | B65D 43/021 206/228 |
| 8,343,560 | B2 * | 1/2013 | Blythe | B65D 11/188 220/4.21 |
| 8,608,008 | B2 * | 12/2013 | Gingras | B65D 43/0254 220/266 |
| 8,684,212 | B2 * | 4/2014 | Stone | B65D 43/0268 220/265 |
| 8,944,270 | B2 * | 2/2015 | Bontrager | B65D 43/0237 220/266 |
| 2010/0072217 | A1 | 3/2010 | Parikh et al. | |
| 2012/0103990 | A1 | 5/2012 | McCumber | |

* cited by examiner

*Primary Examiner* — J. Gregory Pickett
*Assistant Examiner* — Niki M Eloshway
(74) *Attorney, Agent, or Firm* — Stiennon & Stiennon

(57) ABSTRACT

A container has features to indicate tampering and to discourage reuse as a deterrent to use with counterfeit goods. A lid hinged to a thermoformed thermoplastic base defines a product compartment. A line of weakened material surrounds a retention tab within a base upper wall. The tab is secured to a lid upper wall such as by a weld. The retention tab is secured to the lid through an opening in an enclosure element such as a card of thermoformed sheet. When the lid is separated from the base the retention tab is detached from the base along the weakened line of material and retained by the secured connection to the lid with the enclosure element retained by the retention tab to the lid upper wall. The retention tab interferes with the removal of the enclosure element from the lid and its reuse with counterfeit goods.

19 Claims, 2 Drawing Sheets

TRAPPED ELEMENT SECURITY CONTAINER

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to containers in general, and more particularly to containers which give evidence of tampering and which discourage counterfeiting.

Users of high value spare parts and consumables can be targeted by third party manufacturers of substitute products which have a similar appearance to the authentic product, but which lack the oversight and quality control which contribute to optimal performance. These substitutes can be of much lower value than the original equipment manufacturer's product and markets will reflect this in a lower price. Unscrupulous retailers attempt to mislead their customers by passing off the lower value product as an authentic OEM part, thereby securing an unrealisticly high price from a deceived customer. There is even a danger that such a retailer will reuse the authentic OEM packaging to give an appearance of authenticity to the counterfeit goods.

What is needed is a convenient package that gives evidence of tampering and which discourages reuse.

SUMMARY OF THE INVENTION

A container has features to indicate tampering and to discourage reuse as a deterrent to use with counterfeit goods. The container has a thermoformed thermoplastic base and lid which together define a product compartment. The base has an upper wall which extends from a side wall. A line of weakened material surrounds a retention tab within the base upper wall, and that tab is secured to a lid upper wall such as by a weld formed by heat or electrosonic welding. An enclosure element, such as a printed card or an interior thermoformed part, has a planar portion which overlies the retention tab and underlies the lid upper wall. The retention tab is secured to the lid through an opening in the enclosure element planar portion. When the lid is separated from the base the retention tab is detached from the base along the weakened line of material and retained by the secured connection to the lid with the enclosure element retained by the retention tab to the lid upper wall. The retention tab interferes with the removal of the enclosure element from the lid and its reuse with counterfeit goods.

It is an object of the present invention to provide a container for goods which gives evidence of having been opened.

It is a further object of the present invention to provide a container for goods which hampers removal and resuse of product identifying material contained therein.

Further objects, features and advantages of the invention will be apparent from the following detailed description when taken in conjunction with the accompanying drawings.

DESCRIPTION OF THE PREFERRED EMBODIMENTS

Figure 1:
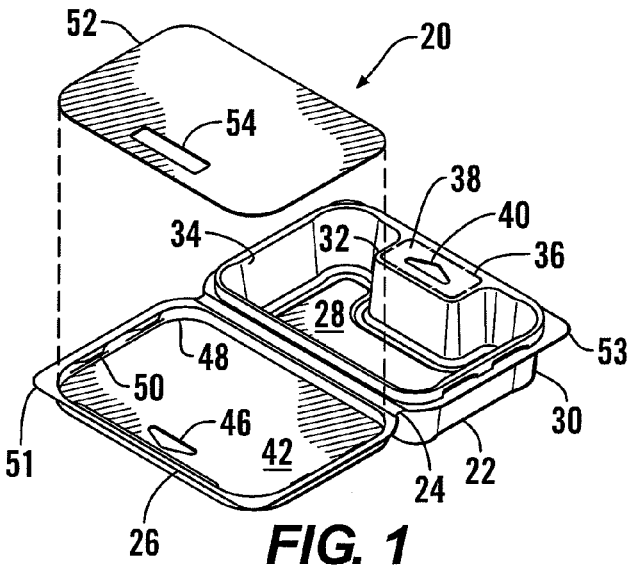
FIG. 1 is an exploded isometric view of the container of this invention.
Figure 2:
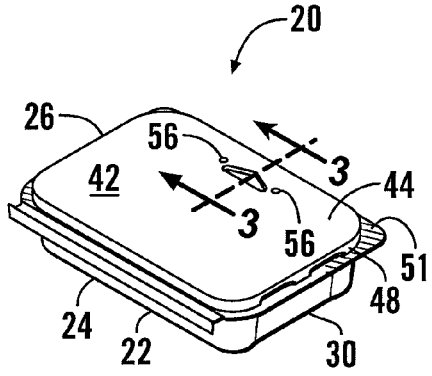
FIG. 2 is an isometric view of the container of FIG. 1 in a closed and sealed configuration.

Referring more particularly to FIGS. 1-7, wherein like numbers refer to similar parts, a container 20 is shown in FIGS. 1-5. The container 20 may be thermoformed of a single sheet of thermoplastic material such as Polyethylene terephthalate (PETE). The container 20 has a base 22 joined by an integral hinge 24 to a lid 26. The base 22 has a bottom wall 28. A side wall 30 extends upwardly from the bottom wall 28 to an upper wall 32. A product compartment 34 is defined above the bottom wall 28.

As shown in FIG. 1, the base upper wall 32 has a weakened line of material 36 formed, for example, by a perforation of the base plastic material. The weakened line of material 36 encircles a portion of the base upper wall 32 to define a retention tab 38. The retention tab 38 may have a central opening which serves as a hang hole 40.

Figure 3:
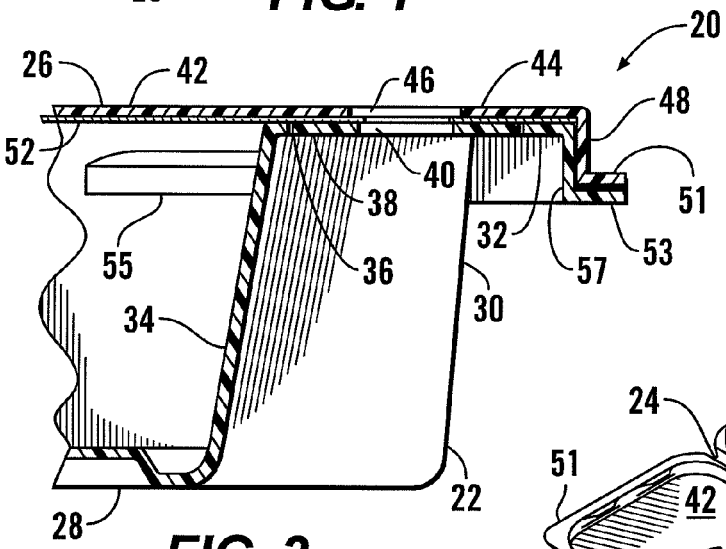
FIG. 3 is a fragmentary cross-sectional view of the container of FIG. 2 taken along section line 3-3.

The lid 26 has an upper wall 42 with a planar portion 44 configured to overlie in parallel relation the retention tab 38 when the lid is closed on the base 22. The planar portion 44 may also have a hang hole 46 positioned to align with the base hang hole 40 in a closed configuration. A lid side wall 48 extends from the upper wall 42, and has a plurality of detents 50 which extend inwardly to support an enclosure element 52 with respect to the lid prior to the lid 26 being closed on the base 22, similar to the card supporting structure shown in U.S. Pat. No. 6,047,819, the disclosure of which is incorporated by reference herein. The lid detents 50 engage with base detents 55 to retain the lid closed on the base. As shown in FIG. 3, a lid flange 51 extends outwardly from the lid side wall 48, and overlies a base flange 53 which extends outwardly from a base skirt 57 which extends downwardly from the base upper wall 32.

The enclosure element 52 is a diecut and printed card, which may be provided with various indicia or security elements such as holograms, etc. (not shown) to deter duplication of the enclosure element by counterfeiters. A through hole 54 extends through the enclosure element 52 planar portion 44 and is smaller than the retention tab 38.

As shown in FIG. 1, the enclosure element 52 is inserted in the lid when the container is in an open configuration. Product, not shown, is loaded into the product compartment 34, and the lid 26 is closed on the base 22. The lid 26 is then secured to the base 22 by forming a secured connection such as by forming two spot welds 56 between the lid upper wall 42 and the retention tab 38 within the boundary of the line of weakened material 36. The spot welds 56 extend through the through opening 54 in the enclosure element, thereby engaging portions of the enclosure element between the retention tab and the lid, and likewise securing the lid in a closed configuration on the base until such time as the line of weakened material is ruptured to separate the retention tab 38 from the base 22. The secured connection can alternatively be provided by heat or electrosonic welding, by adhesive or by a mechanical connection such as mating projections from the base and the lid which are mechanically deformed when brought together to form the secured connection.

Figure 4:
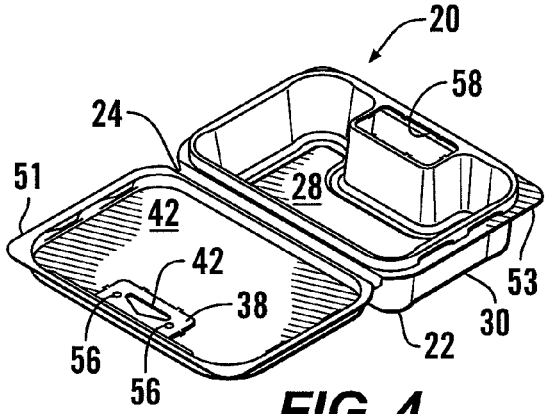
FIG. 4 is an isometric view of the container of FIG. 2 in an opened, tamper-evident configuration.
Figure 5:
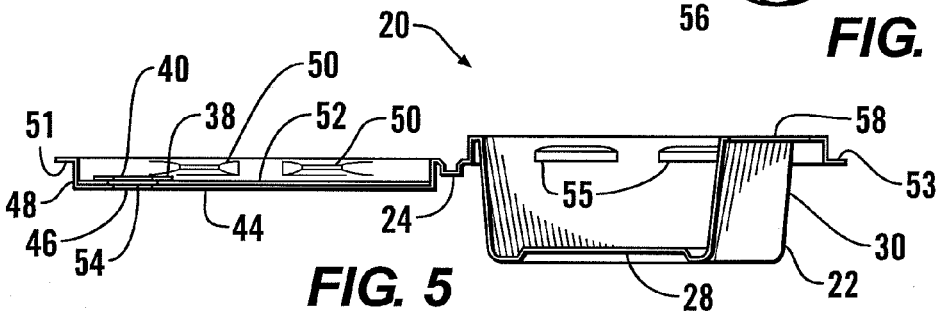
FIG. 5 is a cross-sectional view of the opened container of FIG. 4.

A user opens the container 20 by engaging the overlying base and lid flanges 51, 53 and pulling them apart to separate the lid 26 from the base 22, as shown in FIG. 4. The action of separating the lid from the base causes the base material to fail at the line of weakened material 36, separating the retention tab 38 from the base upper wall 32. A base opening 58 is then formed on the base 22, giving evidence that the container has been opened, even after it is reclosed. Because the welds 56 secure the retention tab 38 to the lid 26, it does not become loose, but continues to be connected to the upper wall 42 of the lid. As shown in FIG. 5, the retention tab 38, being larger than the through hole 54 in the enclosure element 52, prevents the enclosure element from being removed from the lid without being torn or distorted. This serves to prevent the enclosure element 52 and the container 20 from being reused with counterfeit goods, because both components of the packaging will be evidently compromised.

Figure 6:
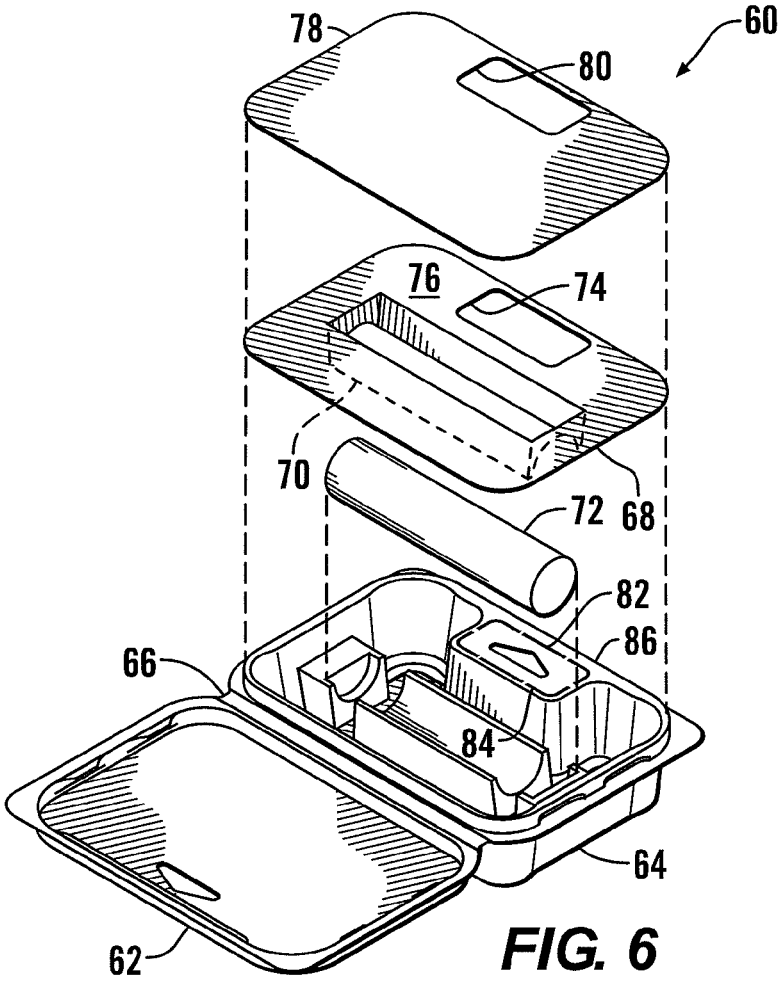
FIG. 6 is an alternative embodiment container of this invention having an internal thermoformed enclosure element.

An alternative embodiment container 60 is shown in FIG. 6. The container 60 has a thermoformed thermoplastic lid 62 joined to a base 64 by a hinge 66. The enclosure element 68 is a thermoformed plastic sheet having a protrusion 70 which serves to engage against and retain a product 72 within the base 64 when the lid 62 is closed on the base. The enclosure element 68 has a through hole 74 which passes through a planar portion 76 of the element. A card 78 overlies the enclosure element 68 and has an aligned through hole 80. The lid 62 may thus be closed on the base 64, and secured through the aligned through holes 74, 80 to a retention tab 82 defined by a weakened line of material 84 in a base upper wall 86. When the sealed container 60 is opened and the weakened line of material 84 is broken, the retention tab remains engaged with the lid, retaining the enclosure element 68 and the card 78 in connection with the lid, giving evidence of tampering.

Figure 7:
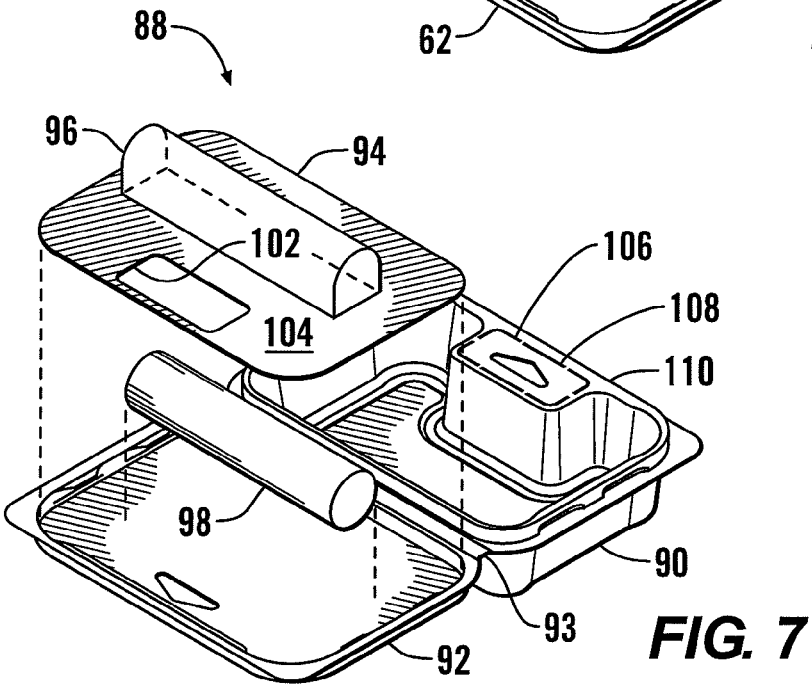
FIG. 7 is another alternative embodiment container of this invention having an internal enclosure element positioned adjacent the lid.

Another alternative embodiment container 88 is shown in FIG. 7. The container 88 has a base 90 joined to a lid 92 by a hinge 93. The container 88 has an enclosure element 94 which is a thermoformed sheet of thermoplastic material, which includes a cavity 96 shaped to receive a product 98 therein and to retain the product in connection with the lid 92. The enclosure element 94 has a through hole 102 which passes through a planar portion 104 of the element. The lid 92 may thus be closed on the base 90, and secured through the through holes 102 to a retention tab 106 defined by a weakened line of material 108 in a base upper wall 110. Thus in this container, when the lid 92 is opened and the retention tab 106 is severed from its connection to the base 90, the product 98 remains enclosed and held against the lid. To access the product 98, the enclosure element 94 may be separated from the lid 92, or, in some cases, it may be possible to distort the enclosure element to allow the product to be removed. Alternatively, the enclosure element 94 may be provided with a line of weakened material defining a region which is readily ruptured to form an access door into the cavity 96.

It should be noted that in place of an integral hinge between the base and the lid, the base may be connected without a hinge.

It is understood that the invention is not limited to the particular construction and arrangement of parts herein illustrated and described, but embraces all such modified forms thereof as come within the scope of the following claims.

I claim:

1. A container comprising:

a thermoformed thermoplastic base having a bottom wall with an upwardly extending side wall and an upper wall which extends from the side wall, a product compartment being defined above the bottom wall;

portions of the base upper wall which define a retention tab, the retention tab being surrounded by a weakened line of material formed in the base upper wall;

a thermoformed thermoplastic lid which overlies the base and the product compartment, the lid having an upper wall which overlies the base upper wall;

an enclosure element positioned between the base and the lid and engaged between the lid upper wall and the base upper wall; and portions of the retention tab which are connected through an opening in the enclosure element to engage the lid to thereby define a secured connection between the lid and the retention tab which engages portions of the enclosure element between the retention tab and the lid, such that when the lid is separated from the base the retention tab is detached from the base along the weakened line of material and retained by the secured connection to the lid, the enclosure element being retained by the retention tab to the lid upper wall.

2. The container of claim 1 wherein the enclosure element comprises a planar card having indicia thereon.

3. The container of claim 1 wherein the enclosure element comprises a thermoformed thermoplastic part.

4. The container of claim 1 wherein the opening in the enclosure element comprises portions defining a through hole, and wherein the secured connection between the base and the lid extends through the enclosure element through hole.

5. The container of claim 1 wherein the secured connection comprises a weld between the base and the lid.

6. The container of claim 1 wherein a hang hole is defined by portions of the retention tab, and wherein the lid upper wall has portions defining a hang hole which is aligned with the retention tab hang hole.

7. The container of claim 1 wherein a side wall extends downwardly from the lid upper wall, and further comprising a plurality of detents which extend inwardly from the lid side wall to support the enclosure element with respect to the lid prior to the lid being closed on the base.

8. The container of claim 1 wherein the base is joined to the lid by an integrally formed hinge.

9. A container comprising:

a base having a bottom wall with an upwardly extending side wall and an upper wall which extends from the side wall, a product compartment being defined above the bottom wall;

portions of the base upper wall which define a retention tab, the retention tab being surrounded by a weakened line of material formed in the base upper wall which;

a lid which overlies the base and the product compartment, the lid having an upper wall which overlies the base upper wall;

an enclosure element having a planar portion positioned between the base and the lid and having a through hole within the planar portion; and portions of the retention tab which are connected through the enclosure element through hole to engage the lid to thereby define a secured connection between the lid and the retention tab which passes through the enclosure element through hole and which engages portions of the enclosure element between the retention tab and the lid, such that when the lid is separated from the base the retention tab is detached from the base along the weakened line of material and retained by the secured connection to the lid, the enclosure element being retained by the retention tab to the lid upper wall.

10. The container of claim 9 wherein the enclosure element comprises a planar card having indicia thereon.

11. The container of claim 9 wherein the enclosure element comprises a thermoformed thermoplastic part.

12. The container of claim 9 wherein the secured connection comprises a weld between the base and the lid.

13. The container of claim 9 wherein a hang hole is defined by portions of the retention tab, and wherein the lid upper wall has portions defining a hang hole which is aligned with the retention tab hang hole.

14. The container of claim 9 wherein a side wall extends downwardly from the lid upper wall, and further comprising a plurality of detents which extend inwardly from the lid side wall to support the enclosure element with respect to the lid prior to the lid being closed on the base.

15. The container of claim 9 wherein the base is joined to the lid by an integrally formed hinge.

16. A container comprising:

a base comprising a bottom wall with an upwardly extending side wall;

a lid which fits over the base, to define a first product compartment between the base and the lid;

portions of the base which define a retention tab surrounded by a line of weakened material; and an enclosure element positioned between the base and the lid, and having a through hole formed therein, wherein the lid is secured to the base retention tab by portions of the retention tab and lid which are connected through the enclosure element through hole, such that when the lid is separated from the base the retention tab is detached from the base along the weakened line of material and retained to the lid, the enclosure element being thereby retained by the retention tab to the lid upper wall.

17. The container of claim 16 wherein the enclosure element has portions defining a protrusion which receives a product therewithin.

18. The container of claim 17 wherein the enclosure element protrusion extends towards the base to engage the product between the protrusion and the base within the first product compartment.

19. The container of claim 17 wherein the enclosure element protrusions extend towards the lid to engage the product between the protrusion and the lid within a second product compartment.

* * * * *